US006252582B1

(12) United States Patent
Rogers et al.

(10) Patent No.: US 6,252,582 B1
(45) Date of Patent: Jun. 26, 2001

(54) ERGONOMIC POINTING DEVICE

(75) Inventors: Michael D. Rogers, El Dorado Hills; Allan E. Schrum, Cameron Park, both of CA (US)

(73) Assignee: Varatouch Technology Incorporated, Sacramento, CA (US)

( * ) Notice: Subject to any disclaimer, the term of this patent is extended or adjusted under 35 U.S.C. 154(b) by 0 days.

(21) Appl. No.: 09/132,563

(22) Filed: Aug. 11, 1998

(51) Int. Cl.[7] ..... G09G 5/00

(52) U.S. Cl. ..... 345/156; 345/157; 345/160; 345/163; 345/168; 345/173

(58) Field of Search ..... 345/156, 161, 345/163, 168, 169, 157, 160, 173

(56) References Cited

U.S. PATENT DOCUMENTS

| | | | | |
|---|---|---|---|---|
| 4,288,836 | * | 9/1981 | Thornburg et al. | 200/600 |
| 4,879,556 | * | 11/1989 | Duimel | 341/20 |
| 5,252,970 | | 10/1993 | Baronowsky | 341/20 |
| 5,309,172 | | 5/1994 | Fox | 345/159 |
| 5,355,147 | | 10/1994 | Lear | 345/156 |
| 5,438,331 | | 8/1995 | Gilligan et al. | 341/35 |
| 5,473,325 | * | 12/1995 | McAlindon | 341/20 |
| 5,499,041 | * | 3/1996 | Brandenburg et al. | 345/174 |
| 5,555,004 | * | 9/1996 | Ono et al. | 345/161 |
| 5,589,828 | * | 12/1996 | Armstrong | 341/20 |
| 5,619,195 | | 4/1997 | Allen et al. | 341/20 |
| 5,638,062 | | 6/1997 | McAlindon | 341/20 |
| 5,675,309 | | 10/1997 | DeVolpi | 338/68 |
| 5,694,152 | | 12/1997 | Loop | 345/157 |
| 5,714,980 | * | 2/1998 | Niino | 345/160 |
| 5,724,068 | * | 3/1998 | Sanchez et al. | 345/161 |
| 5,815,139 | | 9/1998 | Yoshikawa et al. | 345/157 |
| 5,889,507 | * | 3/1999 | Engle et al. | 345/161 |
| 5,943,233 | * | 8/1999 | Ebina et al. | 250/221 |

* cited by examiner

*Primary Examiner*—Richard Hjerpe
*Assistant Examiner*—Henry N. Tran
(74) *Attorney, Agent, or Firm*—Townsend and Townsend and Crew LLP

(57) ABSTRACT

An ergonomic pointing device comprises an orb controller coupled to a resilient return member which is supported on a substrate to move relative to an upper substrate surface of the substrate. The substrate surface has conductive lines and resistive coatings formed thereon or embedded therein. The return member has a conductive surface which is biased with a voltage and is spaced from the substrate surface at rest. When a user applies an external force to the orb controller to move the return member toward the substrate, the conductive surface makes electrical contact with the substrate surface and generates a digital signal. The conductive surface is convex to provide rolling contact with the substrate surface to change the contact location. The orb controller has a curved control surface which is contacted by a digit of a human hand to manipulate movement of the conductive surface relative to the substrate surface. The orb controller has a substantially smaller height than a joystick. The rocking motion created between the conductive surface and substrate surface causes the orb controller to rotate. The rotation of the control surface eliminates the need to rotate the joint of the digit when manipulating the orb controller to move in substantially lateral directions. As a result, the possibility of repetitive stress disorders and pain is greatly reduced.

30 Claims, 3 Drawing Sheets

ERGONOMIC POINTING DEVICE

BACKGROUND OF THE INVENTION

This invention relates generally to pointing devices and, more particularly to an improved pointing device which is ergonomically designed to combine the desirable features of a conventional joystick and a conventional control pad.

Pointing devices including joysticks and control pads are known in the art. Traditional joysticks have been used primarily as a gaming controller, although they have also been employed as general mouse replacement devices. In a typical application, the joystick pointing device is connected via cables to a microcontroller of a computer with a display and a keyboard. The joystick has the advantages of reliability and performance. The joystick also has the advantage of better ergonomic design than the control pad because it allows the digit of the human hand to move laterally without stress to the associated joints of the hand, which means that it is more comfortable to use and less likely to cause any joint damage (e.g., repetitive stress disorder). On the other hand, it has the disadvantage of taking substantial vertical space, which makes it potentially more difficult to physically fit the stick inside a device such as a remote control. Further, the height of the stick makes it more difficult to protect the stick from accidental deflection.

The control pad eliminates the size issues and the associated problems because it takes up no more height than a standard button on a remote control. Unfortunately, they lack the ergonomic advantages of the joystick. More specifically, a conventional disc-type control pad creates significant risk for repetitive stress disorder because, for instance, the pad controller causes the joint of the digit to attempt a rotational movement in the east/west axis (laterally), which causes considerable stress to the joints. Alternately, the user may lift the digit and press the side of the button, but it would result in discontinuous control.

SUMMARY OF THE INVENTION

The present invention provides a pointing device that avoids the problems and disadvantages of the prior art. This goal is accomplished by providing an ergonomic pointing device that functions in an ergonomic manner similar to a joystick but has a significantly reduced height dimension similar to that of a control pad.

In a specific embodiment, a pointing device includes an orb controller which has a much lower physical profile (height) than the joystick. The orb controller has a curved control surface that allows the digits of the hand to move laterally (east/west axis) without causing significant stress on the joints. At rest, the control surface protrudes through an opening in an upper chassis which defines the location for the digit to contact and operate the orb controller. A lower curved contact surface coupled to the orb controller is spaced from a substrate and resiliently supported thereon. When the digit exerts a force on the control surface, the contact surface makes contact with and rolls on the substrate. In another embodiment, the lower contact surface is coupled to the substrate and pivots on the substrate near a center area. Yet another embodiment employs a spring pivoting mechanism coupling the substrate with the orb controller in a manner similar to that described in U.S. Pat. No. 5,675,309, which is incorporated herein by reference in its entirety. The curved control surface allows the digit to move laterally in the east/west direction (as well as north/south, etc.) with ease as the lower contact surface rolls on the substrate. The rotation of the control surface eliminates the need to rotate the joint of the digit, thereby greatly reducing the possibility of repetitive stress disorders and pain.

One aspect of the present invention is a pointing device which comprises a return member being resiliently supported on a substrate surface having an electrically conductive material. The return member has an electrically conductive surface which is substantially convex and spaced from the substrate surface in a first position. A controller is coupled to the return member for moving the return member between the first position and a second position where the electrically conductive surface makes contact with the substrate surface at a contact location. The controller has a disk-like shape with a convex control surface facing away from the substrate surface.

In accordance with another aspect of the invention, a pointing device comprises an electrically conductive surface which is substantially convex. The pointing device further comprises means for supporting the electrically conductive surface relative to a substrate having a substrate surface with an electrically conductive material to move between a neutral position in which the electrically conductive surface is spaced from the substrate surface and a contact position in which the electrically conductive surface makes rolling contact with the substrate surface. A dome-like controller is coupled to the electrically conductive surface and has a convex control surface.

In accordance with another aspect of this invention, a pointing device comprises a control member including an electrically conductive surface facing and spaced in a neutral position from a substrate surface having an electrically conductive material. The control member includes a control surface facing away from the substrate surface. The control member is resiliently supported on the substrate surface to move toward and contact the substrate surface with the electrically conductive surface and to move away therefrom. The electrically conductive surface and the control surface are substantially convex.

BRIEF DESCRIPTION OF THE DRAWINGS

The preferred embodiments of this invention, illustrating all their features, will now be discussed in detail. These embodiments depict the novel and nonobvious pointing device of this invention shown in the accompanying drawings, which are included for illustrative purposes only. These drawings include the following figures, with like numerals indicating like parts.

DESCRIPTION OF THE PREFERRED EMBODIMENT

Figure 1:
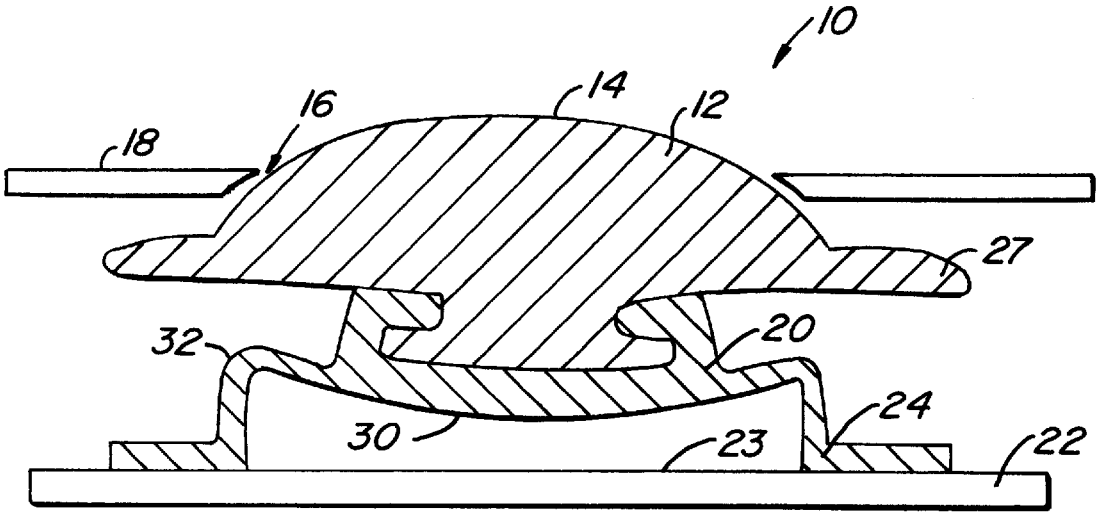
FIG. 1 is a cross-sectional view illustrating a pointing device in a rest mode in accordance with an embodiment of the present invention.
Figure 2:
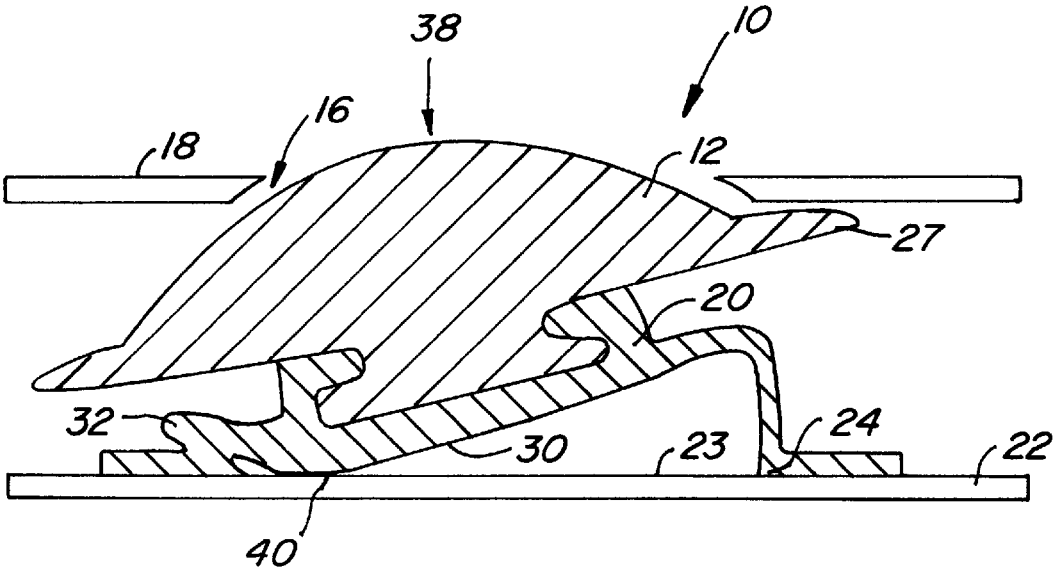
FIG. 2 is a cross-sectional view illustrating the pointing device of FIG. 1 in a deflected mode.

FIGS. 1 and 2 show a pointing device 10 having a controller referred to herein as an orb controller 12 because of its shape and movement. The orb controller 12 has a curved control surface 14 which is contacted typically by the digit or digits or a human hand to manipulate movement of the orb controller 12. In this embodiment, the control surface 14 has a substantially spherical shape to form a dome-like orb controller 12, but may have other shapes such as an ellipsoidal shape. The control surface 14 protrudes through an opening 16 in an upper chassis 18 which defines the location for the digit to contact and operate the orb controller 12. The opening 16 is substantially circular to accommodate the substantially spherically shaped control surface 14. The opening 16 may have other shapes. The opening 16 is sized to expose a sufficient portion of the control surface 14 to allow the digit to operate the full range of movement of the orb controller 12 without lifting the index. The upper chassis 18 is connected to the structure such as a remote control (not shown) which houses the pointing device 10. The pointing device 10 is in a rest mode in FIG. 1. FIG. 2 illustrates the pointing device 10 in a deflected mode when moved by a hand.

The orb controller 12 is connected to a return member 20 which is disposed on a substrate or printed circuit board 22. In the embodiment shown, the return member 20 is connected to the substrate 22 along its outer edge 24. The substrate 22 has an upper substrate surface 23 which is desirably continuous. The outer edge 24 may have any shape. In this embodiment, the pointing device 10 is generally circular and symmetrical, and the outer edge 24 is substantially circular in shape. The substrate surface 23 typically is substantially parallel to a plane defined by the opening 16 of the upper chassis 18, but may be nonparallel thereto. It is understood that the upper chassis 18 is not necessary for the proper operation of the pointing device 10, but is provided to conveniently define a contact area for the digit.

Figure 3A:
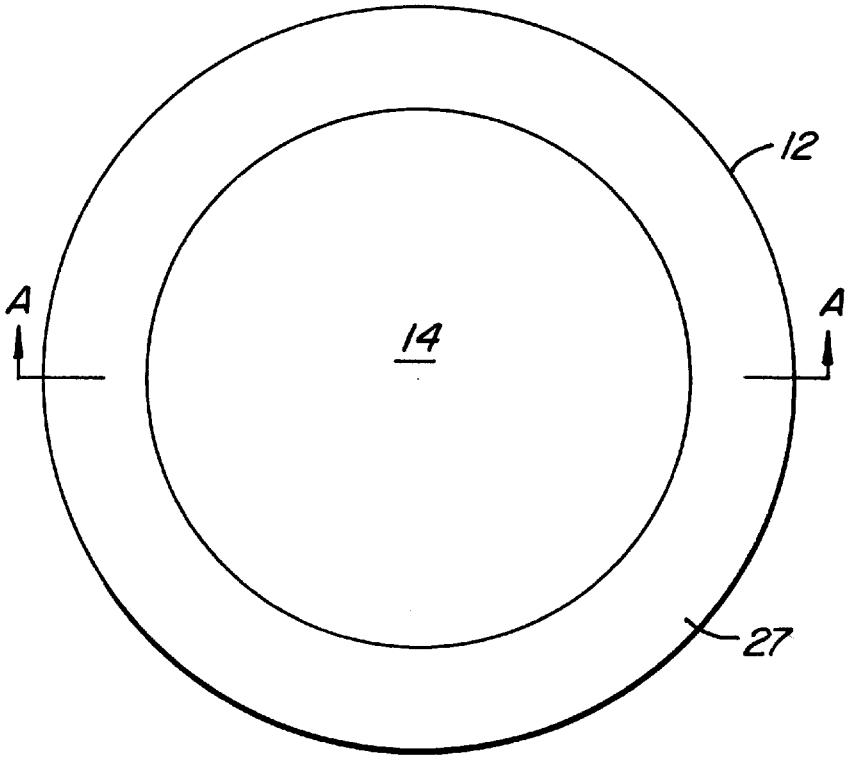
FIG. 3*a* is a top plan view of an orb controller of the pointing device of FIG. 1.
Figure 3B:
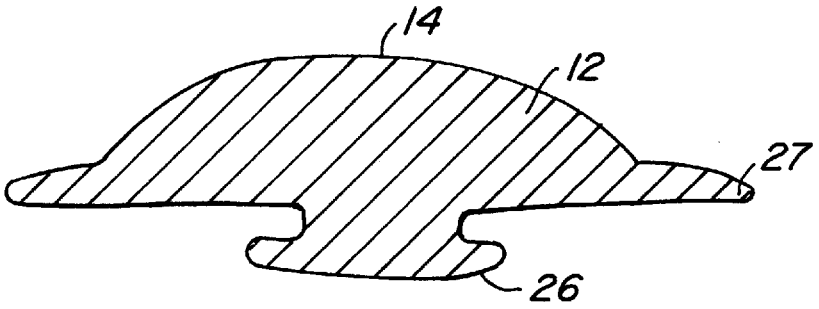
FIG. 3*b* is a cross-sectional view along A—A of the orb controller of FIG. 3*a;*

As best seen in FIGS. 3*a* and 3*b*, the orb controller 12 has a protruded portion or boss 26 opposite from the control surface 14. The orb controller 12 desirably has a substantially annular wing 27 which can serve as a mechanical stop with the chassis 18 to limit the range of movement of the orb controller 12, as best seen in FIG. 2. The wing 27 is of course optional and can be eliminated. The orb controller 12 is substantially symmetrical with respect to a z axis, and is typically made of a polymer such as rubber or plastic.

Figure 3C:
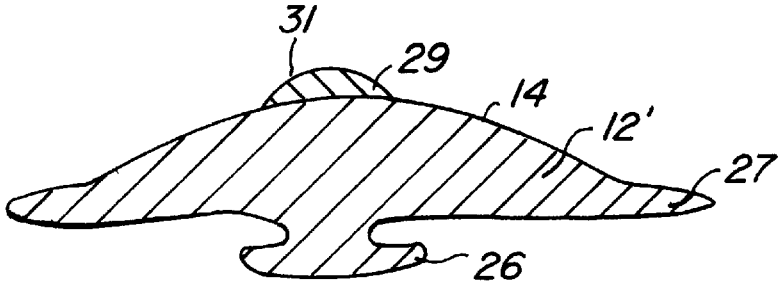
FIG. 3*c* is a cross-sectional view of another embodiment of the orb controller.

Another embodiment of the orb controller 12' is shown in FIG. 3*c* which includes an additional hump 29 on top of the control surface 14. The hump 29 can be integrally formed with the remaining portion of the orb controller 12', or can be a separate component that is connected to the control surface 14. The hump 29 has a curved surface 31 that may be substantially spherical. The curved surface 31 becomes the contact surface the digit or hand of the operator to operate the orb controller 12'. The curved surface 31 of the hump 29 has a smaller curvature than the control surface 14, and provides the sensation of a smaller ball for the digit or hand to operate the orb controller 12'. In this embodiment, the control surface 14 may be more shallow with a lower profile than that of the embodiment shown in FIG. 3*b*, so that the maximum height of the orb controller 12' remains small and approximately the same as the maximum height of the orb controller 12 of FIG. 3*b* without the hump 29.

Figure 4A:
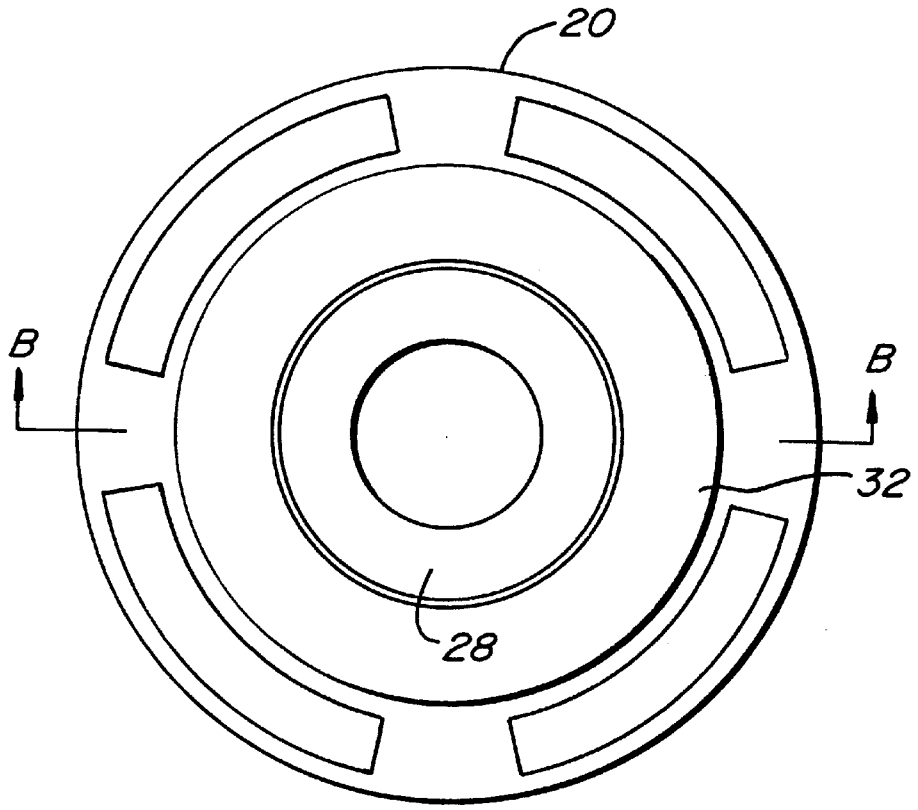
FIG. 4*a* is a top plan view of a return member of the pointing device of FIG. 1.
Figure 4B:
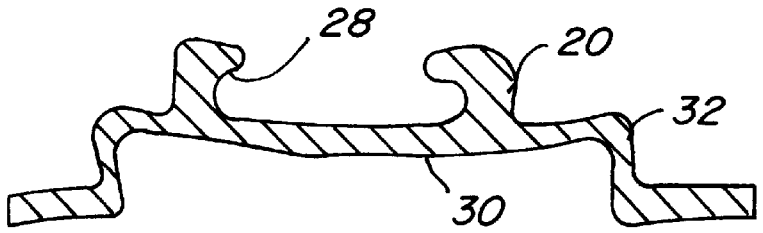
FIG. 4*b* is a cross-sectional view along B—B of the return member of FIG. 4*a*.

The return member 20 is best seen in FIGS. 4*a* and 4*b*, and is advantageously resilient. The return member 20 is substantially symmetrical with respect to the z axis at rest (FIG. 1). The return member 20 includes a seat 28 having a cavity for receiving the boss 26 of the orb controller 12. The boss 26 is shaped to cooperate in a fitted manner with the cavity of the seat 28, as shown in the assembled device 10 of FIGS. 1 and 2. The return member 20 has sufficient resiliency to allow the boss 26 to fit into the cavity of the seat 28 to secure easily the orb controller 12 and the return member 20 together. This design also makes it convenient to separate the orb controller 12 from the return member 20 and replace the orb controller 12.

The return member 20 has a conductive surface 30 disposed below the seat 28. The conductive surface 30 is desirably curved with a substantially convex shape. An annular arch 32 connects the seat 28 to the outer edge 24 of the return member 20. The annular arch 32 between the seat 28 and the outer edge 24 provides additional flexibility for the return member 20 to function as a non-spring return mechanism for the pointing device 10. In the embodiment of FIGS. 1–2, the annular arch 32 is advantageously thinner than the other portions of the return member 42. Other configurations such as an accordion-like structure (not shown) are possible. The separate orb controller 12 can isolate and insulate the user's hand from the electrical circuitry and components that include the conductive surface 30 of the return member 20 and the upper surface 23 of the substrate 22. The boss 26 and seat 28 combination allows the thickness of the portion of the return member 20 adjacent the conductive surface 30 to be relatively thin. As a result, the return member 20 of the pointing device 10 tends to deform and reform more smoothly and reliably. Other configurations of the return member for resiliently supporting the conductive surface 30 relative to the substrate surface 23, such as those that employ springs, are possible.

The resilient return member 20 is electrically conductive, at least at the conductive surface 30, which is spaced from the substrate surface 23 of the substrate 22 in the neutral, undeflected state shown in FIG. 1. An electrical voltage is applied to the return member 20 to produce an energizing voltage therein. The voltage can be produced by any method known in the art. For example, the voltage can be created by electrically contacting the return member 20 (or at least the conductive surface 30) with one or more electrical conductors or contacts (not shown) spaced along its outer edge 24. In applications where the pointing device 10 is used with microprocessors, the typical voltage applied to the return member 20 is about 3–5 volts. The voltage can be different for other applications.

The conductive surface 30 is resiliently supported by the substrate 22 along the outer edge 24 to be movable or displaceable between the undeflected mode shown in FIG. 1 and the deflected mode shown in FIG. 2. In the deflected mode, the conductive surface 30 is pressed in the direction of the arrow 38 to make contact with the upper surface 23 of the substrate 22 to form a contact location 40. The convex conductive surface 30 rocks on the substrate surface 23 of the substrate 22 in the deflected mode. As the conductive surface 30 rocks on the substrate surface 23 of the substrate 22, the contact location 40 between the conductive surface 30 and the substrate surface 23 is changed.

The substrate 22 in this embodiment is substantially planar and circular, but other shapes are possible. The substrate surface 23 of the substrate 22 has circuit paths or conductive lines and resistive coatings formed thereon or embedded therein or otherwise provided on the surface. Various analog/digital circuitry patterns that can be formed on the upper surface 23 of the substrate 22 are known in the art and are not described herein. In this embodiment, the return member 20 advantageously encloses the substrate surface 23 and protects the circuitry on the substrate surface 23 from the external environment.

The pointing device 10 has a height that is preferably smaller than, and more preferably substantially smaller than, a joystick. When assembled in the rest mode (FIG. 1), the maximum height of the control surface 14 from the substrate surface 23 is a function of the size of the pointing device (such as the area of the substrate surface 23 and size of the return member 20). For a substantially circular substrate surface 23 defined by the outer edge 24 of the return member 20, one possible criterion can specify the maximum height of the control surface 14 at rest as a function of the diameter of the substrate surface 23. For example, the maximum height can be set at about 0.5–1.5 times, and more desirably about 0.8–1.2 times, the diameter of the substrate surface 23. In a typical application, the maximum height is desirably less than about 25 mm, and more desirably about 13–15 mm. To control the maximum height to within the specified range, one can provide a thin orb controller 12 with a short boss 26 and/or a thin return member 20 with the conductive surface 30 spaced from the substrate surface 23 by a small minimum clearance in the undeflected mode. For instance, a moderately convex control surface 14 will produce a thinner orb controller 12 than a steep control surface 14, while a moderately convex conductive surface 30 will also produce a thinner return member 20 than a steep conductive surface 30. In one embodiment, the orb controller 12 has a circular dome-like or disc-like shape with a maximum diameter, and a maximum thickness of less than about 0.5 time, and more desirably less than about 0.2 times, the maximum diameter. When the hump 29 is present (FIG. 3*c*), its maximum thickness is less than about 0.2 times, and more desirably less than about 0.1 times, the maximum diameter. The hump 29 typically has a maximum thickness measured from the control surface 14 of less than about 0.5 times the maximum overall thickness of the control member 12. The minimum clearance between the conductive surface 30 and the substrate surface 23 in the undeflected mode is typically less than about 1 mm, and more desirably less than about 0.5 mm.

In operation, when the orb controller 12 is pressed downward, the resilient return member 20 is deflected toward the substrate 22. The deflection causes the conductive surface 30 of the return member 20 to engage the upper surface 23 of the substrate 22 and make electrical contact therewith at the contact location 40, as best seen in the illustrated deflected mode in FIG. 2. The rocking motion created between the conductive surface 30 and substrate surface 23 causes the orb controller 12 as well as the return member 20 to rotate. The rotation of the control surface 14 eliminates the need to rotate the joint of the digit when manipulating the orb controller 12 to move in the east/west direction (as well as other substantially lateral directions). As a result, the possibility of repetitive stress disorders and pain is greatly reduced. The orb controller 12 has a much lower physical profile (height) than a joystick, and overcomes the stress problems associated with a control pad. Therefore, the pointing device 10 is more versatile and safe to use.

The conductive surface 30 of the return member 20 is biased with an applied voltage. The circuitry pattern on the substrate surface 23 has electrical contacts (digital) that are closed when an external force is applied. Signals so developed are supplied, for instance, to a microcontroller (not shown) to wake up the microcontroller and/or to inform the microcontroller of the direction and speed of the movement caused by the external force. The larger the displacement of the orb controller 12, the further out the contact location 40 is between the conductive surface 30 and the analog/digital circuitry on the substrate surface 23. This produces a variable signal that is due to the angular displacement of the orb controller 12. Furthermore, the corresponding increase in force on the orb controller 12 and return member 20 either increases the surface area of contact for a change in resistance, or changes the absolute point of contact 40 on the analog/digital contact on the substrate surface 23, thereby changing the point of the voltage potential. This changes the analog voltage as detected on the substrate surface 23. Using methods known in the art, the detected information can be used to calculate the contact location 40 between the conductive surface 30 of the return member 20 and the substrate surface 23. The software in the microcontroller interprets the data relating to this change and directs an output to a relevant receiver that can be connected by a wire or similar structural members.

Upon release of all external forces on the orb controller 12, the return member 20 moves back to its neutral position and the conductive surface 30 is again spaced from the substrate surface 23 (FIG. 1). The material and geometry of the return member 20 are selected to facilitate repeated deformation and reformation of the return member 20 between the deflected and undeflected modes in a smooth and reliable manner. The resilient return member 20, including the conductive surface 30, may be made of low durometer rubber that is conductive. The return member 20 typically has a very low resistance, for instance, below about 500 ohms. The orb controller 12 may be made of the same material as the return member 20. In other embodiments, the interior of the resilient return member 20 may be hollow or filled with a suitable filler such as plastic. These components of the pointing device 10 may be made by, for example, molding. In the embodiment shown in FIGS. 1–4, the orb controller 12 and return member 20 are separate components that are connected together to form the pointing device 10. In other embodiments, the orb controller 12 and return member 20 may be made of the same material, and be integrally formed together. The components of the pointing device 10 can be made, for example, by molding.

It will be understood that the above-described arrangements of apparatus and methods therefrom are merely illustrative of applications of the principles of this invention and many other embodiments and modifications may be made without departing from the spirit and scope of the invention as defined in the claims. For instance, the return member 20 can be formed with a resistive surface instead of the conductive surface 30, and the substrate surface 23 can include a conductive material without resistive coatings. In a specific embodiment, the return member 20 comprises a resistive material which is desirably a resistive rubber. The resistive rubber may include a resistive material, such as carbon or a carbon-like material, imbedded in a rubber material. The resistive rubber advantageously has a substantially uniform or homogeneous resistance. In most applications, the resistive rubber used has a moderate resistance below about 50 thousand ohms and more desirably below about 25 thousand ohms, for instance, between about 5,000 and 10,000 ohms.

In operation, a voltage variance is provided over the resistive surface, and desirably over the resistive return member 20. The voltage variance can be produced by any method known in the art. For example, the voltage variance can be created by electrically contacting the resistive return member 20 with a plurality of electrical contacts (not shown) spaced along its outer edge 24. There are at least two, and desirably four, such electrical contacts (east, west, north, south). Each pair of opposite electrical contacts are energized with a voltage potential. The voltage-potential-energized electrical contacts produce a voltage variance across the resistive surface of the resistive return member 20. Details of a similar configuration are found in a co-pending application, Ser. No. 08/939,377, filed Sep. 29, 1997 and assigned to Varatouch Technology Incorporated, the assignee of the present application. The entire disclosure of this application is incorporated herein by reference. In addition, the conductive surface 30 may be coupled to the substrate surface 23 and pivots on the substrate 22 near a center area in another embodiment. Yet another embodiment employs a spring pivoting mechanism coupling the substrate 22' with the orb controller 12 in a manner similar to that described in U.S. Pat. No. 5,675,309.

What is claimed is:

1. A pointing device comprising:

a return member being resiliently supported on a substrate surface having an electrically conductive material, the return member having an electrically conductive surface which is spaced from the substrate surface in a first position; and a controller coupled to the return member for moving the return member between the first position and a second position where the electrically conductive surface makes contact with the substrate surface at a contact location, the controller having a disk-like shape with a convex control surface on which to place one or more human digits for manipulating the controller to move the return member between the first position and the second position and to rock the electrically conductive surface on the substrate surface to change the contact location, the convex control surface facing away from the substrate surface, the electrically conductive surface varying in shape during movement on the substrate surface.

2. The pointing device of claim 1, wherein the electrically conductive surface is substantially convex.

3. The pointing device of claim 1, wherein the controller has a substantially circular shape with a maximum diameter and a maximum thickness of less than about 0.2 times the maximum diameter.

4. The pointing device of claim 3, wherein the substrate surface is substantially planar and circular with a substrate diameter and the control surface is spaced from the substrate surface in the first position by a maximum distance of less than about 1.5 times the substrate diameter.

5. The pointing device of claim 1, wherein the control surface is spaced from the substrate surface by a maximum distance of less than about 25 mm in the first position.

6. The pointing device of claim 1, further comprising a chassis spaced from the substrate surface and having an opening through which a portion of the control surface of the controller protrudes.

7. The pointing device of claim 6, wherein the opening of the chassis is substantially circular.

8. The pointing device of claim 6, wherein the electrically conductive surface has a center area which is spaced closest to the substrate surface in the first position, and the opening of the chassis is substantially aligned with the center area of the electrically conductive surface.

9. The pointing device of claim 1, wherein the return member comprises a low durometer rubber.

10. The pointing device of claim 1, wherein the return member has an outer edge which is connected to the substrate surface.

11. The pointing device of claim 1, wherein the return member at least substantially encloses the substrate surface from external environment.

12. The pointing device of claim 1, wherein the return member includes a flexible annular arch which resiliently supports the electrically conductive surface relative to the substrate surface.

13. A pointing device comprising:

an electrically conductive surface;

means for supporting the electrically conductive surface relative to a substrate having a substrate surface with an electrically conductive material to move between a neutral position in which the electrically conductive surface is spaced from the substrate surface and a contact position in which the electrically conductive surface makes rolling contact with the substrate surface; and a dome-like controller coupled to the electrically conductive surface and having a convex control surface on which to place one or more human digits for manipulating the controller to move the electrically conductive surface between the neutral position and the contact position and to roll the electrically conductive surface on the substrate surface to change a contact location between the electrically conductive surface and the substrate surface, the convex control surface facing away from the substrate surface the electrically conductive surface varying in shape during movement on the substrate surface.

14. The pointing device of claim 13, wherein the dome-like controller has a maximum diameter and a maximum height of less than about 0.5 times the maximum diameter.

15. The pointing device of claim 13, wherein the control surface is spaced from the substrate surface in the neutral position by a maximum distance of about 13–15 mm.

16. The pointing device of claim 13, wherein the substrate surface is substantially planar and circular with a substrate diameter and the control surface is spaced from the substrate surface in the neutral position by a maximum distance of about 0.8–1.2 times the substrate diameter.

17. A pointing device comprising a control member including an electrically conductive surface facing a substrate surface having an electrically conductive material, the control member being resiliently supported on the substrate surface to move the electrically conductive surface on the substrate surface, the control member including a dome-shaped control surface on which to place one or more human digits for manipulating the control member to roll the electrically conductive surface on the substrate surface to change a contact location between the electrically conductive surface and the substrate surface, the convex control surface facing away from the substrate surface, the electrically conductive surface varying in shape during movement on the substrate surface.

18. The pointing device of claim 17, wherein the control member is resiliently supported on the substrate surface to between from a contact position in contact with the substrate surface and a noncontact position away from the substrate surface.

19. The pointing device of claim 17, wherein the electrically conductive surface has an area which is spaced closest to the substrate surface in the noncontact position by a distance of less than about 1 mm.

20. The pointing device of claim 17, wherein the substrate surface is substantially planar and circular with a substrate diameter and the control surface is spaced from the substrate surface in the neutral position by a maximum distance of about 1.5 times the substrate diameter.

21. The pointing device of claim 17, wherein the substrate surface includes a resistive coating.

22. The pointing device of claim 17, wherein the electrically conductive surface of the control member includes a resistive material.

23. The pointing device of claim 22, wherein the electrically conductive surface has a substantially uniform resistance.

24. The pointing device of claim 22, wherein the control member comprises a resistive rubber material.

25. The pointing device of claim 24, wherein the resistive rubber material comprises carbon or other conducting material embedded in rubber.

26. The pointing device of claim 17, wherein the control surface includes a hump on which to place the human digit for manipulating the controller, the hump protruding from a center region thereof.

27. The pointing device of claim 26, wherein the hump has an exposed curved surface which is smaller in curvature than the control surface.

28. The pointing device of claim 26, wherein the hump has a maximum thickness measured from the control surface of less than about 0.5 times the maximum thickness of the control member.

29. A pointing device comprising:

a return member being resiliently supported on a substrate surface having an electrically conductive material, the return member having a dome-shaped electrically conductive surface which is spaced from the substrate surface in a first position; and a controller coupled to the return member for moving the return member between the first position and a second position where the electrically conductive surface makes contact with the substrate surface at a contact location, the controller having a disk-like shape with a dome-shaped convex control surface on which to place one or more human digits for manipulating the controller to move the return member between the first position and the second position and to rock the electrically conductive surface on the substrate surface to change the contact location, the convex control surface facing away from the substrate surface.

30. The pointing device of claim 29, wherein the electrically conductive surface varies in shape during movement on the substrate surface.

* * * * *